US005285593A

United States Patent [19]

Bammate

[11] Patent Number: 5,285,593

[45] Date of Patent: Feb. 15, 1994

[54] DEVICE FOR RECOVERING CARTRIDGE CASES FOR AN AUTOMATIC OR SEMIAUTOMATIC FIREARM

[75] Inventor: Timour Bammate, Paris, France

[73] Assignee: Marianne Bammate, Paris, France

[21] Appl. No.: 987,668

[22] Filed: Dec. 9, 1992

[30] Foreign Application Priority Data

Mar. 11, 1992 [CH] Switzerland ..... 00794/92

[51] Int. Cl.[5] ..... F41A 9/60

[52] U.S. Cl. ..... 42/98

[58] Field of Search ..... 42/98; 89/33.4

[56] References Cited

U.S. PATENT DOCUMENTS 3,739,685 6/1973 Lundgren ..... 42/98

4,028,834 6/1977 Dobson ..... 42/98

4,334,375 6/1982 Olson ..... 42/98

*Primary Examiner*—Stephen C. Bentley

*Attorney, Agent, or Firm*—Anthony J. Casella; Gerald E. Hespos

[57] ABSTRACT

The device comprises a removable container (7) having an entrance opening (8) located opposite the window (2) for the ejection of the cases of fired cartridges of a firearm (1) having a carrying handle (4) with two spaced posts (5, 6) on the top of its frame, and all-azimuth temporary attachment means for attaching the container to these two posts comprising a fork (9) engaged around on post (5) of the carrying handle, a lock (10–12) with movable bolt (11) engaged around the other post (6), and a height retention stop (13, 12) associated with each of said two attachment means.

8 Claims, 1 Drawing Sheet

DEVICE FOR RECOVERING CARTRIDGE CASES FOR AN AUTOMATIC OR SEMIAUTOMATIC FIREARM

BACKGROUND OF THE INVENTION

The present invention relates to a device for recovering cartridge case for an automatic or semiautomatic firearm having an ejection window for the cases of fired cartridges, a loading handle, and a carrying handle with two spaced posts on the top of its frame, comprising a removable container with means for permitting the temporary attachment thereof to the firearm and an entrance opening intended to come opposite the ejection window for the cartridge cases in order to collect them during the firing.

Devices of this type have been developed in an attempt to solve in the best possible manner the problems relating to their manner of attachment to and detachment from the firearm for which they are intended.

The handling of the device necessary by the detachment and particularly the successive reattachments of the container in order to recover the cases collected may in fact result in losses in time and irritation, and it is desirable to make these operations as simple and rapid as possible.

Depending on the position of the loading handle with respect to the ejection window for the fired cartridge cases, it may be difficult or inconvenient to reach said handle for manual rearming necessary for instance upon a change of the clip or else after each small series of shots upon practice.

The fact of having to detach the container in such cases may also result in a loss of time and irritation upon training and it is desirable in such cases to facilitate access to the loading handle.

Devices for the recovery of cartridge cases which are specifically suitable for firearms having a carrying handle on the top of their frame and a loading handle on the rear of the breech have been developed.

These devices, described in U.S. Pat. No. 3,739,685, U.S. Pat. No. 4,028,834 and U.S. Pat. No. 4,334,375 have the feature in common that they comprise a first means of attachment to the firearm consisting of a holding flange which caps the top of the frame of the firearm between the two posts of the carrying handle. A second attachment means is formed either by a boss on the bottom of the container, held by threading in an element attached to the side of the firearm, as in the first document cited, or by a clip collar intended to surround and grip the barrel of the firearm in front of the cartridge case ejection window as in the second document cited, or by a pin which can be inserted through hinge elements connecting the bottom of the container to the frame of the firearm, two of these elements being attached to the latter in front of and behind the ejection window below it, as in the third document. In the first said document, the container has a cover the opening of which, by pivoting, makes it possible to withdraw the recovered cases. In the second document, the container is a flexible bag of netting mounted on a frame which pivots downward to permit the recovery of the cases. In the third document, the container is detachable from its attachment means by a so-called VELCRO tape entrance frame.

The said known devices, however, are not suitable for firearms with carrying handle having a loading handle on the top of the firearm between the two posts of said handle, due to the presence there of their first attachment means formed by their retaining flange. They are not adapted furthermore to facilitate access to a loading handle of a firearm on which this handle is arranged in the region of the ejection window for the cases of the cartridges fired.

OBJECTS AND SUMMARY OF THE INVENTION

The object of the present invention is a device for recovering cartridge cases which has an attachment system of universal type which is simple and rapid to put in place and remove and can be easily adapted, in principle, to any type of firearm having a carrying handle on the top of its frame, whatever the position of its loading handle.

For this purpose, the device of the invention is characterized by the fact that the attachment means of the container comprise a fork intended to be engaged in the carrying handle around a post thereof, a lock with slide bolt intended to be engaged by horizontal pivoting of the container against the other post, the engagement of the slide bold around the latter assuring the locking of the container in longitudinal and transverse directions, and at least one height retention stop in the carrying handle associated with each of said attachment means.

In this way, the placing of the device on the firearm is made very easy and can be effected with a single hand by bringing the fork against one post of the carrying handle and then pivoting the container until the lock is engaged against the other post, the catching of the slide bolt around the latter being adapted to be effected almost simultaneously either by means of a finger of the same hand, in which case the bolt is made movable, or automatically, in which case the bolt is adapted for spring engagement. The removal of the device is effected just as simply by the opposite maneuvers, first disengaging the bolt of the lock and then the fork. Transformations of the firearm or adaptations of its frame are not necessary.

The fact of having attachment means which rest on the two posts of the carrying handle makes it possible to free to the utmost the top of the frame of the firearm between them, which is suitable in the case of attachment of the device to a firearm the loading handle of which occupies this space.

Finally, the lack of the need of a retainer for the container below the ejection window for the fired cartridge cases or in front thereof, which is made possible by the principle of maintaining all azimuths on only the two posts of the carrying handle makes it possible to join the fork to the lock by a horizontal hinge element to which the container is articulated. It is thus possible to free access to the loading handle of the firearm which has said handle near the ejection window for the fired cartridge cases, for instance by swinging the container upward.

BRIEF DESCRIPTION OF THE DRAWINGS

The accompanying drawing shows three embodiments of the object of the invention by way of example.

DETAILED DESCRIPTION OF THE PREFERRED EMBODIMENT

Figure 1:
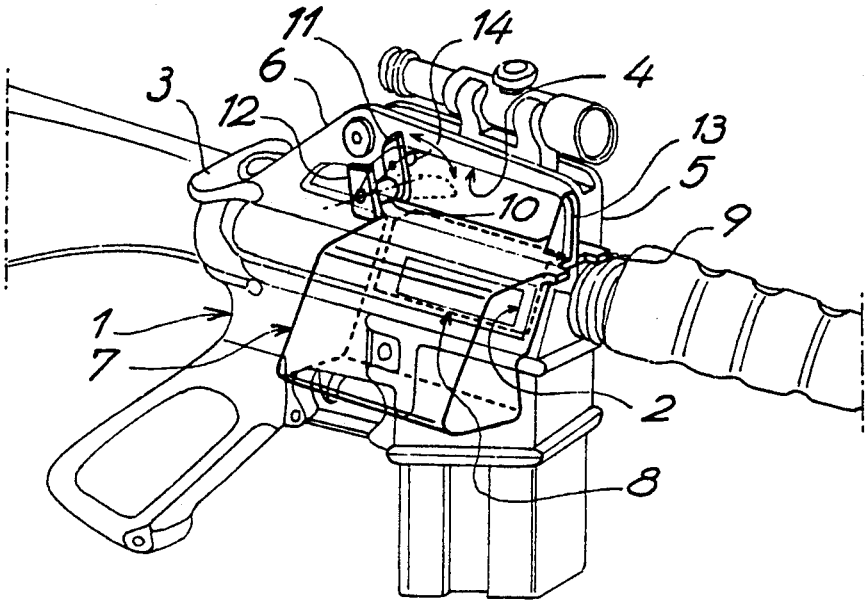
FIG. 1 is an overall view of the first embodiment.

In its first embodiment, shown in FIG. 1, the cartridge cases recovery device is mounted fixed to a semi-automatic shoulder arm 1 having a carrying handle 4 with two posts 5 and 6 spaced apart on the top of its frame, a side window 2 for the ejection of the fired cartridge cases, and a loading handle 3 located here behind its breech. A firing sight is mounted on the handle 4.

The device comprises a removable container 7 formed of a rigid quadrangular box, for instance of plastic, having an entrance opening 8 located opposite the ejection window 2 of the firearm, with means for attachment to the two posts 5 and 6 of the carrying handle 4 comprising:

a fork 9 gripping here the front post 5 of the carrying handle and being integral with the upper wall of the container 7;

a lock formed of a vertical wall 12 resting against one face of the other post 6 and a vertical slide bolt 11 movable by pivoting in a vertical plane, articulated on the transverse horizontal axis of a barrel 10, the wall 12 and the barrel 10 being fastened to the upper wall of the container 7 and the space between said wall of the container 7 and the space between said wall 12 and the bolt 11 being so adapted as to assure the retaining of the bolt by friction against the said post after its manual engagement by pivoting from a swung-back position shown in thin dash lines;

a first height retention stop in the handle 6, formed here by the vertical wall 12 of the lock, which comes to rest below the upper wall of a lateral chambering of the rear post 6 of the handle;

a second height retention stop 13 in the handle 6, associated by rigid fastening to the fork 9, striking below the cross member of the handle 4.

Due to this system of attachment, after the post 5 has been surrounded by the fork 9 and the bolt 11 being swung back into low position, shown in dash lines, the lock 10, 12 is engaged in the handle 4 against the post 6 and the assembly is locked in all azimuths by engagement of the bolt 11, and this in very simple manner and by the use of only one hand. A handle 14, fastened to the bolt 11, facilitates the manipulating of the latter.

The device itself is of great simplicity in structure and, aside from the movable bolt 11 and its articulation shaft, can be molded in a single part.

Figure 2:
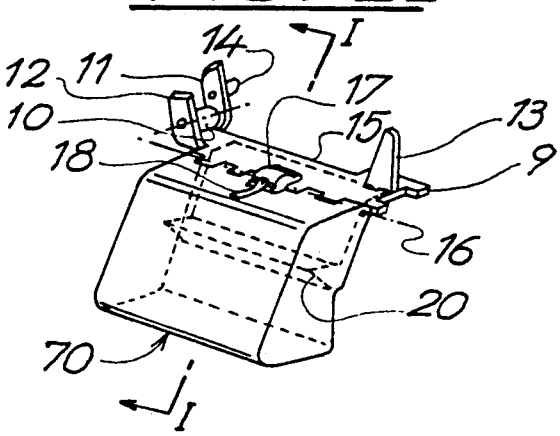
FIG. 2 is an overall view of the second embodiment.
Figure 3:
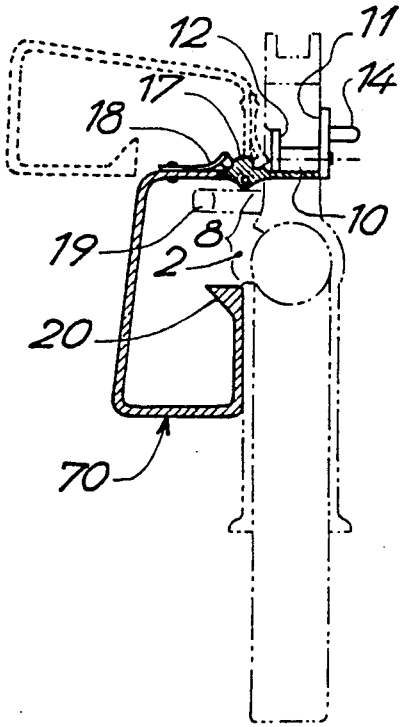
FIG. 3 is a vertical cross section of the second embodiment along the section axis I—I of FIG. 2.

The second embodiment, shown in FIGS. 2 and 3, is given as example of adaptation to a firearm having a carrying handle of the same type as that shown in FIG. 1 but having a loading handle 19 (FIG. 3) located in the region of the window 2 for the ejection of the cases of the fired cartridges.

In this second embodiment, the attachment means of the container 70, namely the fork 9, lock 10–12, bolt 11 and height retention posts 12 and 13, are identical to those of the first embodiment which has already been described, and they have the same functions.

However, in this case, these attachment means are rigidly connected with a hinge plate 15 with longitudinal horizontal axis of articulation 16, to which the container 70 is articulated in such a manner that the latter can pivot upward and vice versa in a vertical plane, and this from a low position shown in solid lines in FIG. 2, in which the container is in position for recovery of the cases of fired cartridges, against the frame of the firearm, up to an upper position, shown in dash lines, in which access to the loading handle 19 of the firearm is assured.

The temporary holding of the container 70 in these two upper and lower positions is assured here by a retention device which operates by engagement of a spring pawl 10 fastened to the container 70 in a sector 17 which is integral with the hinge plate 15, having two spaced engagement notches positioned at an angle in correspondence with these two positions.

The retaining force of this engagement system is so adapted as to be easily overcome manually but is, however, sufficient to maintain the container firmly in the two positions selected when filled with cases.

In order to prevent the falling down of the cartridge cases contained in the container in upper position, an inner wall return 20 is provided here, located at the lower limit of its opening 8, this not being indispensable but constituting an appreciable advantage when the loading handle 19 is to be manipulated rapidly during firing while the container is not yet full of cases.

Figure 4:
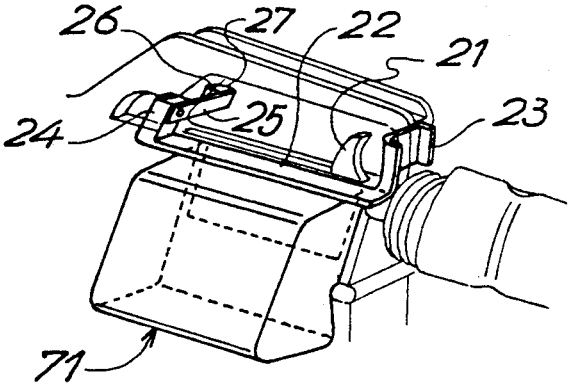
FIG. 4 is an overall view of the third embodiment.

The third embodiment, shown in FIG. 4, is given as example of adaptation to a firearm having a loading handle 21 on the top of its frame, between the two posts of its carrying handle.

In this third embodiment, the attachment means for the container 71 comprise, in this case also, a fork 23 and a lock 2425 with bolt 26 engaging the two posts of the carrying handle of the firearm.

But in this case, these attachment means are so designed as to free to the maximum the stroke of the loading handle 21 in the following manner:

the fork 23 is formed by a vertical retention flange of U-shaped cross section, the two flanges of which surround the front post of the carrying handle of the firearm and the web of which constitutes a height retention stop, by resting below the cross member of the carrying handle;

the lock 24–25 with bolt 26 is formed of a post 24 which rests against one side of the rear post of the carrying handle and comes to stop vertically, here also, below the upper wall of a lateral chambering in said post, of a transverse spring leaf fastened to the post 24 of the lock and of a bolt 26 fastened at the end of said spring leaf so as to grip, with said post 24, around the rear post of the handle;

the bolt 26 has a slanting outer face 27 intended to facilitate its elastic engagement in the handle before its engagement by elastic return of the spring 25 from the other side of the post of the handle;

the fork 23 and the lock 24–25 with bolt 26 are held in positions offset towards the firearm by a plate 22 which is fastened to the upper wall of the container 71 and frees to the utmost the stroke of the loading handle 21, and the thicknesses of the web of the U-shaped fork 23 and of the spring 25 are sufficiently small not to limit this forward and rearward stroke.

Variations in the structures of the device may be made without going beyond the scope of the invention.

Thus, the front position the fork and the rear position of the lock can be reversed on the carrying handle of the firearm.

The movable bolt 11 of the first and second embodiments may be retained engaged otherwise than by friction, for instance by ratchet engagement on the barrel 10.

The system of retention in two positions of the articulated container 70 of the second embodiment may be different from the engagement means 17-10 shown, for instance by means of a swing spring on both sides of a neutral intermediate position.

When the firearm in question has no chambering in the rear post 6 of its carrying handle, the side post 12 of the lock no longer plays its height retention role, and it is then necessary either to associate with it a central post which fulfills this role by resting below the cross member of the handle 4 or to extend this lateral post 12 by an inner fold which plays said role.

The bolt 11 can be movable by translation in the manner of the bolt of a lock.

Finally, the invention does not exclude the possibility of combining together the different structures shown, as for example the placement of the attachment means 9-13, 10-11-12 of the first two embodiments by the attachment means 23, 24-25-26 of the third embodiment, the latter in this case being directly mounted on the container 7 of the first embodiment, fastened to a firearm having a loading handle 3 at the rear of the breach, or mounted on the hinge plate 15 of the second embodiment fastened to a firearm having a loading handle in the region of the window for the ejection of the cases of the fired cartridges.

Similarly, a fork 23 (FIG. 4) can replace the fork 9/post 13 assembly (FIGS. 1 and 2).

I claim:

1. A device for recovering cartridge cases for an automatic or semiautomatic firearm having a window for the ejection of the cases of the cartridges fired, a loading handle, and a carrying handle with two posts spaced apart on the top of its frame, comprising a removable container with means permitting its temporary attachment to the firearm and an entrance opening intended to be opposite the cartridge-case ejection window in order to collect the cases upon the firing, characterized by the fact that the attachment means of the container (7, 70, 71) comprise a fork (9, 23) intended to be engaged in the carrying handle (4) around an upright (5) of the latter, a lock (10-12, 24-25) with bolt (11, 26) intended to be engaged by horizontal pivoting of the container against the other post (6), the engagement of the bolt around the latter assuring the immobilizing of the container in the longitudinal and transverse directions, and at least one height retention stop (12, 13, 23, 24) in the carrying handle associated with each of the said attachment means.

2. A device according to claim 1, characterized by the fact that it comprises a lock (10-12) with bolt (11) movable for manual engagement.

3. A device according to claim 1, characterized by the fact that it comprises a lock (24-25) with bolt (27) with spring (25) for automatic elastic engagement.

4. A device according to claim 3, characterized by the fact that it comprises a lock (24-25) with bolt (26) with spring (25) and a fork (23) in the form of a vertical flange of U-shaped cross section which are held in offset positions towards the firearm by a plate (22) fastened to the container (71) and free the stroke of the loading handle (21) of the firearm having said handle on the top of its frame between the two posts of its carrying handle.

5. A device according to claim 1, characterized by the fact the fork (9), the lock (10-12) with bolt (11) and the height retention stops (12-13) are fastened on the upper wall of the container (7).

6. A device according to claim 1, characterized by the fact that the fork (9), the lock (10-12) with bolt (11) and the height retention stops (12-13) are fastened on a hinge plate (15) with horizontal/longitudinal articulation axis (16) on which the container (70) is articulated, the latter having the capability of pivoting from a bottom position for receiving cases of fired cartridges into a top position freeing the access to the loading handle (19) of a firearm having such handle in the region of the window for the ejection of the cases of the fired cartridges.

7. A device according to claim 1, characterized by the fact that it comprises a fork (23) formed by a vertical flange of U-shaped cross section the two flanges of which surround one post of the carrying handle and the web of which constitutes a height retention stop.

8. A device according to claim 7, characterized by the fact that it comprises a lock (24-25) with bolt (26) with spring (25) and a fork (23) in the form of a vertical flange of U-shaped cross section which are held in offset positions towards the firearm by a plate (22) fastened to the container (71) and free the stroke of the loading handle (21) of the firearm having said handle on the top of its frame between the two posts of its carrying handle.

* * * * *